US008834302B2

(12) United States Patent
Nakamura et al.

(10) Patent No.: US 8,834,302 B2
(45) Date of Patent: Sep. 16, 2014

(54) GOLF BALL

(75) Inventors: Hirotaka Nakamura, Kobe (JP); Hyoungchol Kim, Kobe (JP)

(73) Assignee: Sri Sports Limited, Kobe (JP)

( * ) Notice: Subject to any disclaimer, the term of this patent is extended or adjusted under 35 U.S.C. 154(b) by 796 days.

(21) Appl. No.: 13/023,586

(22) Filed: Feb. 9, 2011

(65) Prior Publication Data

US 2011/0195802 A1 Aug. 11, 2011

(30) Foreign Application Priority Data

Feb. 10, 2010 (JP) ..... 2010-027093

(51) Int. Cl.
*A63B 37/12* (2006.01)
*A63B 37/00* (2006.01)

(52) U.S. Cl.
CPC ..... *A63B 37/0004* (2013.01); *A63B 37/0033* (2013.01); *A63B 37/0064* (2013.01); *A63B 37/0018* (2013.01); *A63B 37/0074* (2013.01); *A63B 37/0087* (2013.01); *A63B 37/0083* (2013.01); *A63B 37/0019* (2013.01); *A63B 37/0015* (2013.01); *A63B 37/0017* (2013.01); *A63B 37/0021* (2013.01); *A63B 37/002* (2013.01); *A63B 37/0035* (2013.01); *A63B 37/008* (2013.01); *A63B 37/0012* (2013.01); *A63B 37/0005* (2013.01); *A63B 37/0006* (2013.01)
USPC ..... 473/383

(58) Field of Classification Search
USPC ..... 473/378–385
See application file for complete search history.

(56) References Cited

U.S. PATENT DOCUMENTS

| | | | | |
|---|---|---|---|---|
| 5,470,076 | A * | 11/1995 | Cadorniga | 473/384 |
| 5,720,676 | A | 2/1998 | Shimosaka et al. | |
| 5,980,232 | A | 11/1999 | Shimosaka et al. | |
| 6,039,660 | A * | 3/2000 | Kasashima et al. | 473/378 |
| 6,162,136 | A | 12/2000 | Aoyama | |
| 6,176,793 | B1 | 1/2001 | Sullivan et al. | |
| 6,558,274 | B1 | 5/2003 | Shimosaka | |
| 6,632,150 | B1 | 10/2003 | Ogg | |

(Continued)

FOREIGN PATENT DOCUMENTS

| | | | |
|---|---|---|---|
| JP | 6-190082 | A | 7/1994 |
| JP | 9-94309 | A | 4/1997 |

(Continued)

OTHER PUBLICATIONS

Japanese Office Action for Japanese Application No. 2010-027093, dated Jan. 10, 2012.

*Primary Examiner* — Raeann Gorden
(74) *Attorney, Agent, or Firm* — Birch, Stewart, Kolasch & Birch, LLP

(57) ABSTRACT

A cross-sectional shape of each of dimples 8 of a golf ball is a wave-like curve. The wave-like curve has two first projections 16, two second projections 18, two first recesses 20, and two second recesses 22. A circular arc 14 passes through one edge Ed, a deepest point Pd, and another edge Ed. Each first projection 16 is located above the circular arc 14. Each second projection 18 is located above the circular arc 14. Each first recess 20 is located below the circular arc 14. Each second recess 22 is located below the circular arc 14. The ratio of the distance Lp from an edge Ed to a peak Pp to the radius (Di/2) of the dimple 8 is equal to or greater than 20% but equal to or less than 70%.

17 Claims, 12 Drawing Sheets

(56) References Cited

U.S. PATENT DOCUMENTS

| | | | | |
|---|---|---|---|---|
| 7,250,012 | B1 | 7/2007 | Simonds et al. | |
| 2001/0036872 | A1 | 11/2001 | Kasashima et al. | |
| 2003/0114255 | A1 | 6/2003 | Dalton et al. | |
| 2003/0190968 | A1 | 10/2003 | Kasashima | |
| 2004/0132551 | A1 | 7/2004 | Aoyama et al. | |
| 2004/0198536 | A1* | 10/2004 | Ohama et al. | 473/378 |
| 2006/0068942 | A1* | 3/2006 | Ohama et al. | 473/378 |
| 2007/0259738 | A1 | 11/2007 | Sato et al. | |
| 2008/0004137 | A1 | 1/2008 | Kasashima et al. | |

FOREIGN PATENT DOCUMENTS

| | | | |
|---|---|---|---|
| JP | 11-57065 | A | 3/1999 |
| JP | 2001-276277 | A | 10/2001 |
| JP | 2002-537914 | A | 11/2002 |
| JP | 2003-154031 | A | 5/2003 |
| JP | 2004-195226 | A | 7/2004 |
| JP | 2004-209258 | A | 7/2004 |
| JP | 2007-301359 | A | 11/2007 |

* cited by examiner

GOLF BALL

This application claims priority on Patent Application No. 2010-27093 filed in JAPAN on Feb. 10, 2010. The entire contents of this Japanese Patent Application are hereby incorporated by reference.

BACKGROUND OF THE INVENTION

1. Field of the Invention

The present invention relates to golf balls. Specifically, the present invention relates to improvement of dimples of golf balls.

2. Description of the Related Art

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force which acts upon the golf ball. The reduction of drag and the enhancement of lift force are referred to as a "dimple effect". Excellent dimples efficiently disturb the air flow. The excellent dimples produce a long flight distance.

There have been various proposals for the shapes of dimples. U.S. Pat. No. 7,250,012 discloses a golf ball which has dimples each having an annular tubular portion.

U.S. Pat. No. 6,558,274 (JP2001-54592) discloses a golf ball which has first dimples and second dimples. The second dimples are recessed from the first dimples.

U.S. Pat. No. 6,162,136 (JP2002-531232) discloses a golf ball which has dimples each having a central depression, a land ring and an annular depression.

US 2003/190968 (JP-2003-290390) discloses a golf ball which has dimples each having a projecting bottom. The curvature radius of the bottom is large.

US 2008/004137 (JP2008-12300) discloses a golf ball which has dimples each having a projection. The projection is surrounded by a ring-shaped recess.

The greatest interest to golf players concerning golf balls is flight distance. In light of flight performance, there is room for improvement in the shapes of dimples. An object of the present invention is to provide a golf ball having excellent flight performance.

SUMMARY OF THE INVENTION

A golf ball according to the present invention has a large number of dimples on a surface thereof. Each dimple has a curved surface. A cross-sectional shape of the curved surface is a wave-like curve having:

(1) one or more projections located above a circular arc which passes through one dimple edge, a deepest point of the dimple, and another dimple edge; and (2) one or more recesses located below the circular arc. A ratio of a distance between a peak of a projection closest to a dimple edge and the dimple edge, to a radius of the dimple, is equal to or greater than 20% but equal to or less than 70%.

In the golf ball according to the present invention, drag is small at the initial stage of a trajectory, and a lift force is great at the latter stage of the trajectory. The golf ball has excellent flight performance.

Preferably, one recess is present between the projection closest to the dimple edge and the dimple edge.

Preferably, the wave-like curve is obtained by combining a sine curve and a circular arc. Preferably, a number of cycles of the wave-like curve is equal to or greater than 2.0 but equal to or less than 6.0.

The wave-like curve may be obtained by combining a cosine curve and a circular arc. Preferably, a number of cycles of the wave-like curve is equal to or greater than 2.5 but equal to or less than 7.0.

Preferably, the wave-like curve has 3 to 7 projections.

DESCRIPTION OF THE PREFERRED EMBODIMENTS

The following will describe in detail the present invention based on preferred embodiments with reference to the accompanying drawings.

Figure 1:
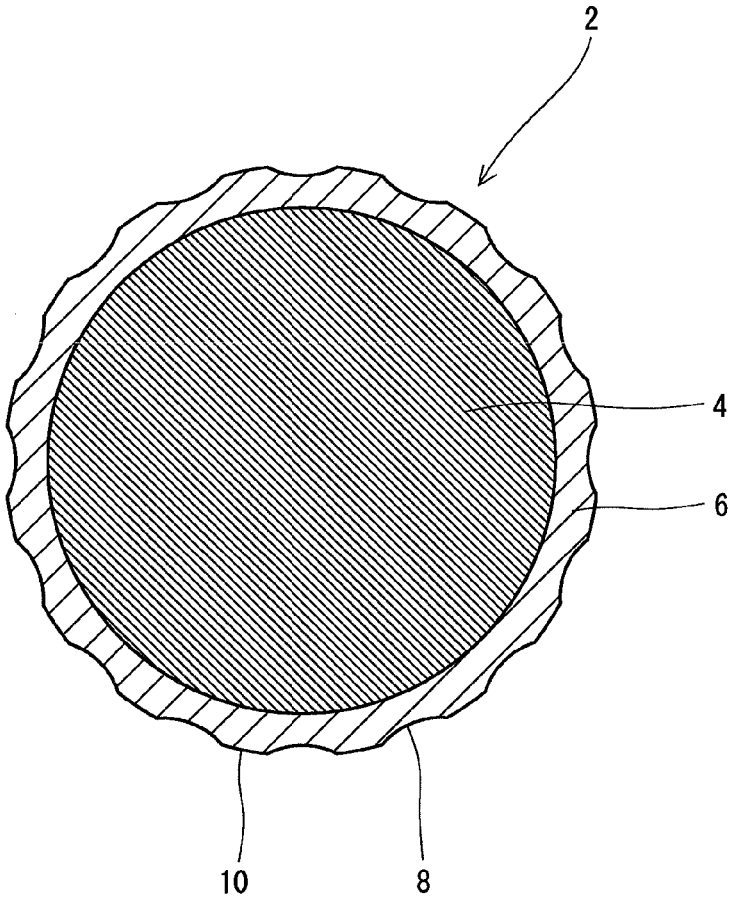
FIG. 1 is a cross-sectional view of a golf ball according to an embodiment of the present invention.
Figure 2:
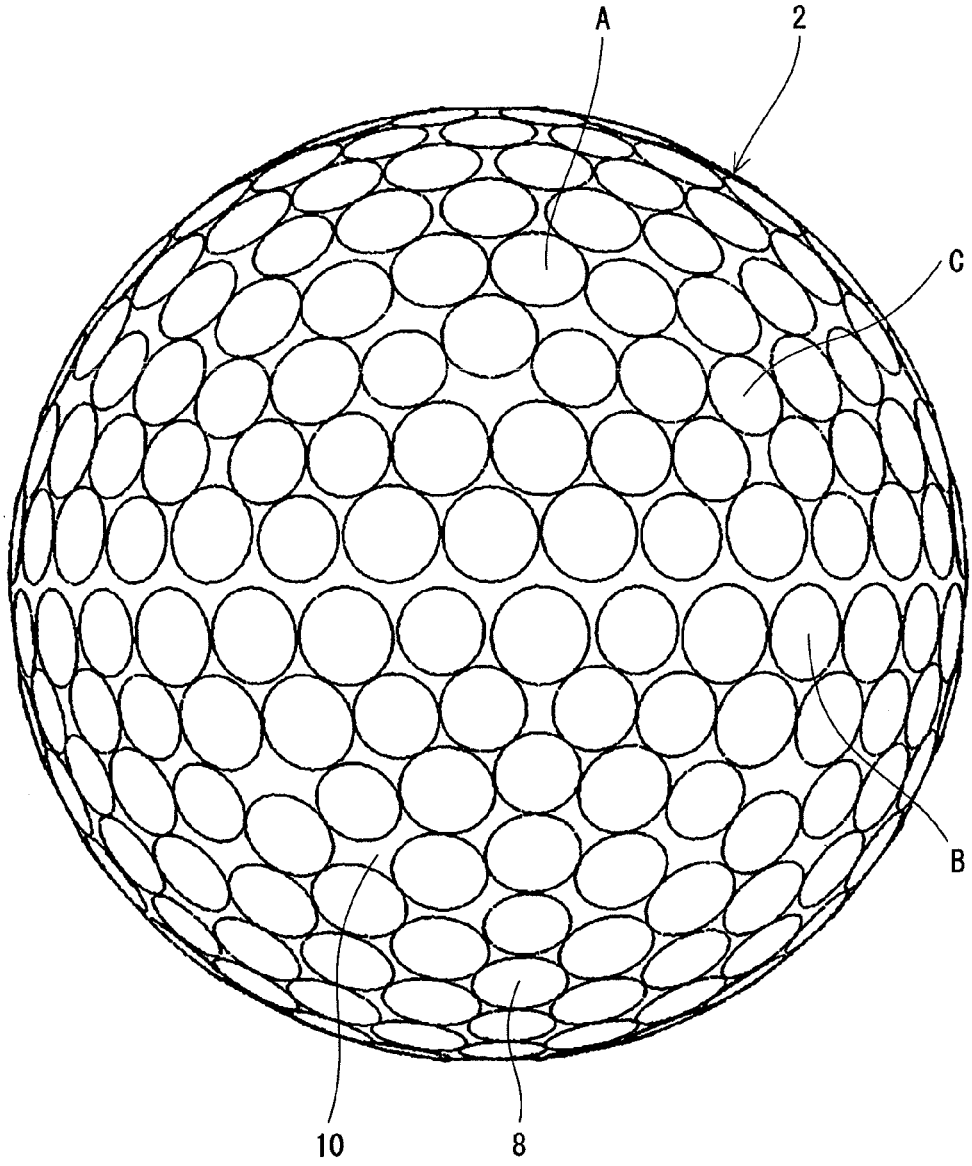
FIG. 2 is an enlarged front view of the golf ball in FIG. 1.
Figure 3:
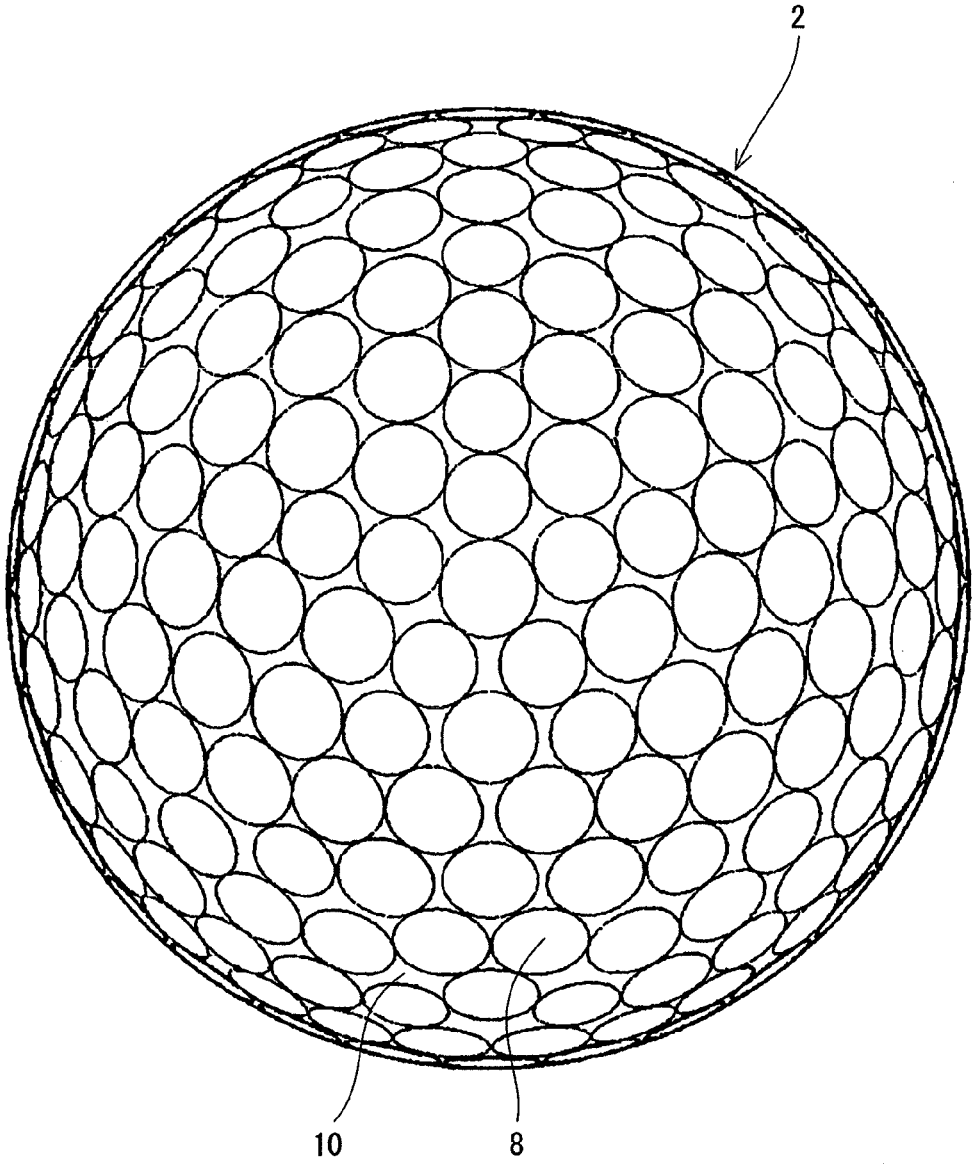
FIG. 3 is a plan view of the golf ball in FIG. 2.

A golf ball 2 shown in FIGS. 1 to 3 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 preferably has a diameter of 40 mm or greater and 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 preferably has a weight of 40 g or greater and 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of base rubbers for use in the rubber composition include polybutadienes, polyisoprenes, styrene-butadiene copolymers, ethylene-propylene-diene copolymers and natural rubbers. Two or more of these rubbers may be used in combination. In light of resilience performance, polybutadienes are preferred, and in particular, high-cis polybutadienes are preferred.

In order to crosslink the core 4, a co-crosslinking agent is suitably used. Examples of preferable co-crosslinking agents in light of resilience performance include zinc acrylate, magnesium acrylate, zinc methacrylate and magnesium methacrylate. Preferably, the rubber composition includes an organic peroxide together with a co-crosslinking agent. Examples of suitable organic peroxides include dicumyl peroxide, 1,1-bis(t-butylperoxy)-3,3,5-trimethylcyclohexane, 2,5-dimethyl-2,5-di(t-butylperoxy)hexane and di-t-butyl peroxide.

According to need, various additives such as a filler, sulfur, a vulcanization accelerator, a sulfur compound, an anti-aging agent, a coloring agent, a plasticizer, a dispersant and the like are included in the rubber composition for the core 4 in an adequate amount. Synthetic resin powder or crosslinked rubber powder may be also included in the rubber composition.

The core 4 has a diameter of preferably 30.0 mm or greater and particularly preferably 38.0 mm or greater. The diameter of the core 4 is preferably equal to or less than 42.0 mm and particularly preferably equal to or less than 41.5 mm. The core 4 may be formed with two or more layers. The core 4 may have a rib on the surface thereof. The core 4 may be hollow.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion and neodymium ion.

Another polymer may be used for the cover 6 instead of an ionomer resin. Examples of the other polymer include polyurethanes, polystyrenes, polyamides, polyesters and polyolefins. In light of spin performance and scuff resistance, polyurethanes are preferred. Two or more of these polymers may be used in combination.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the cover 6 at an adequate amount. For the purpose of adjusting specific gravity, powder of a metal with a high specific gravity such as tungsten, molybdenum and the like may be included in the cover 6.

The cover 6 has a thickness of preferably 0.2 mm or greater and particularly preferably 0.3 mm or greater. The thickness of the cover 6 is preferably equal to or less than 2.5 mm and particularly preferably equal to or less than 2.2 mm. The cover 6 has a specific gravity of preferably 0.90 or greater and particularly preferably 0.95 or greater. The specific gravity of the cover 6 is preferably equal to or less than 1.10 and particularly preferably equal to or less than 1.05. The cover 6 may be formed with two or more layers.

As shown in FIGS. 2 and 3, the contour of the dimple 8 is circular. The golf ball 2 has dimples A each having a diameter of 4.46 mm; dimples B each having a diameter of 4.36 mm; and dimples C each having a diameter of 3.90 mm. The number of types of the dimples 8 is three. The number of the types may be one, two, or four or more. The number of the dimples A is 112; the number of the dimples B is 100; and the number of the dimples C is 120. The total number of the dimples 8 is 332.

Figure 4:
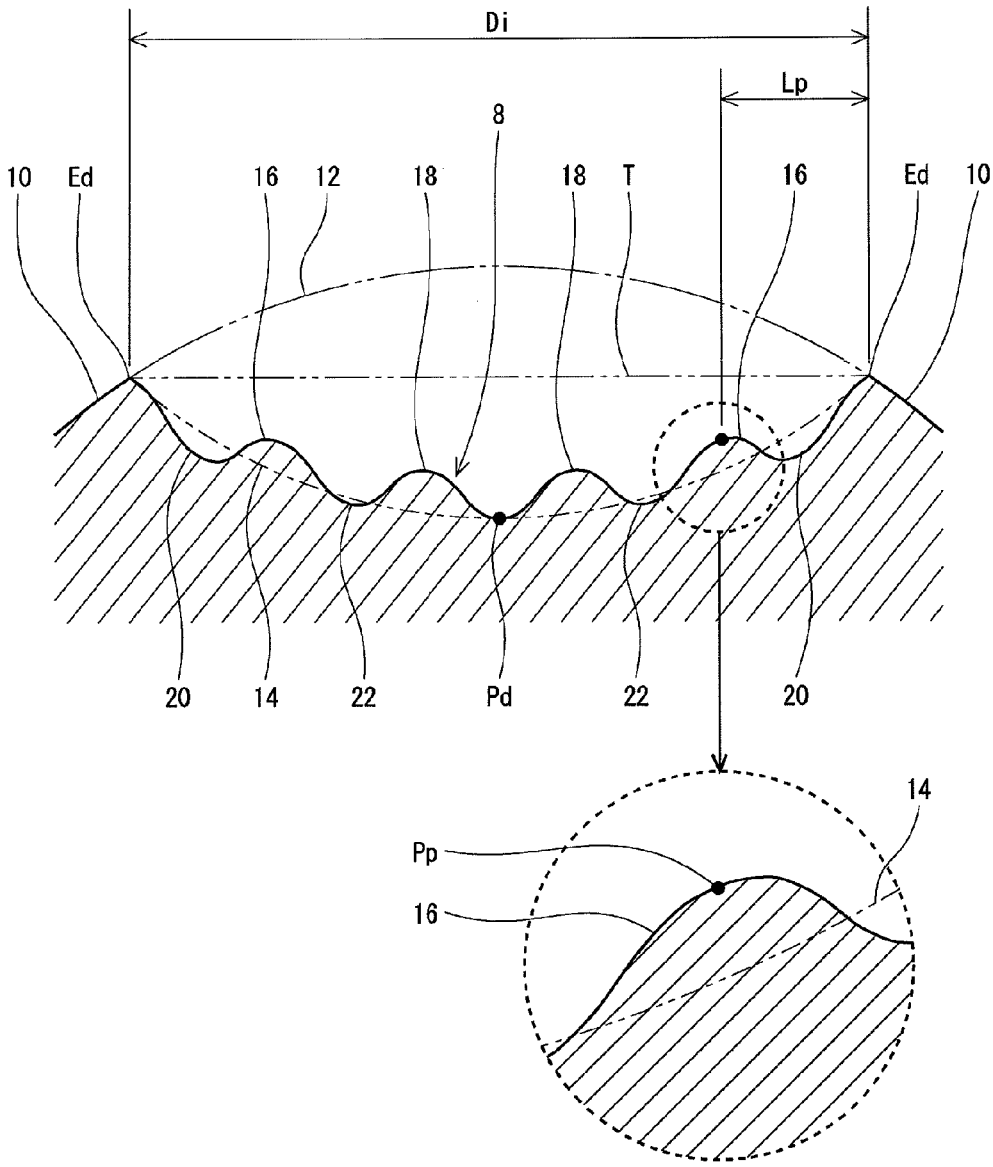
FIG. 4 is an enlarged cross-sectional view of a dimple of the golf ball in FIG. 1.

FIG. 4 shows a cross section along a plane passing through the center of the dimple 8 and the center of the golf ball 2. The dimple 8 is formed from a curved surface. In FIG. 4, the top-to-bottom direction is the depth direction of the dimple 8. In FIG. 4, what is indicated by a chain double-dashed line 12 is the surface of a phantom sphere. The surface of the phantom sphere 12 is the surface of the golf ball 2 when it is postulated that no dimple 8 exists. The dimple 8 is recessed from the surface of the phantom sphere 12. The land 10 agrees with the surface of the phantom sphere 12.

In FIG. 4, what is indicated by a double ended arrow Di is the diameter of the dimple 8. The diameter Di is the distance between two tangent points Ed appearing on a tangent line T which is drawn tangent to the far opposite ends of the dimple 8. Each tangent point Ed is also the edge of the dimple 8. The edge Ed defines the contour of the dimple 8. The diameter Di is preferably equal to or greater than 2.0 mm but equal to or less than 6.0 mm. By setting the diameter Di to be 2.0 mm or greater, a superior dimple effect is achieved. In this respect, the diameter Di is more preferably equal to or greater than 2.50 mm and particularly preferably equal to or greater than 3.0 mm. By setting the diameter Di to be 6.0 mm or less, a fundamental feature of the golf ball 2 being substantially a sphere is not impaired. In this respect, the diameter Di is more preferably equal to or less than 5.5 mm and particularly preferably equal to or less than 5.0 mm.

As shown in FIG. 4, a cross-sectional shape of the dimple 8 is a wave-like curve. The wave-like curve extends from one edge Ed to another edge Ed. What is indicated by a reference sign Pd is the deepest point of the dimple 8. The deepest point Pd is a point, on the surface of the dimple 8, which has a largest distance from the tangent line T. What is indicated by a reference numeral 14 is a circular arc which passes through the one edge Ed, the deepest point Pd, and the other edge Ed.

The wave-like curve has two first projections 16, two second projections 18, two first recesses 20, and two second recesses 22. Each first projection 16 is located above the circular arc 14. Each second projection 18 is located above the circular arc 14. Each first recess 20 is located below the circular arc 14. Each second recess 22 is located below the circular arc 14. The circular arc 14 is a reference for discriminating between the projections and the recesses. The first recess 20, the first projection 16, the second recess 22, and the second projection 18 are arranged in this order from the edge Ed toward the deepest point Pd. The first recess 20 is adjacent to the edge Ed. The first projection 16 is closer to the edge Ed than the second projection 18.

Figure 5:
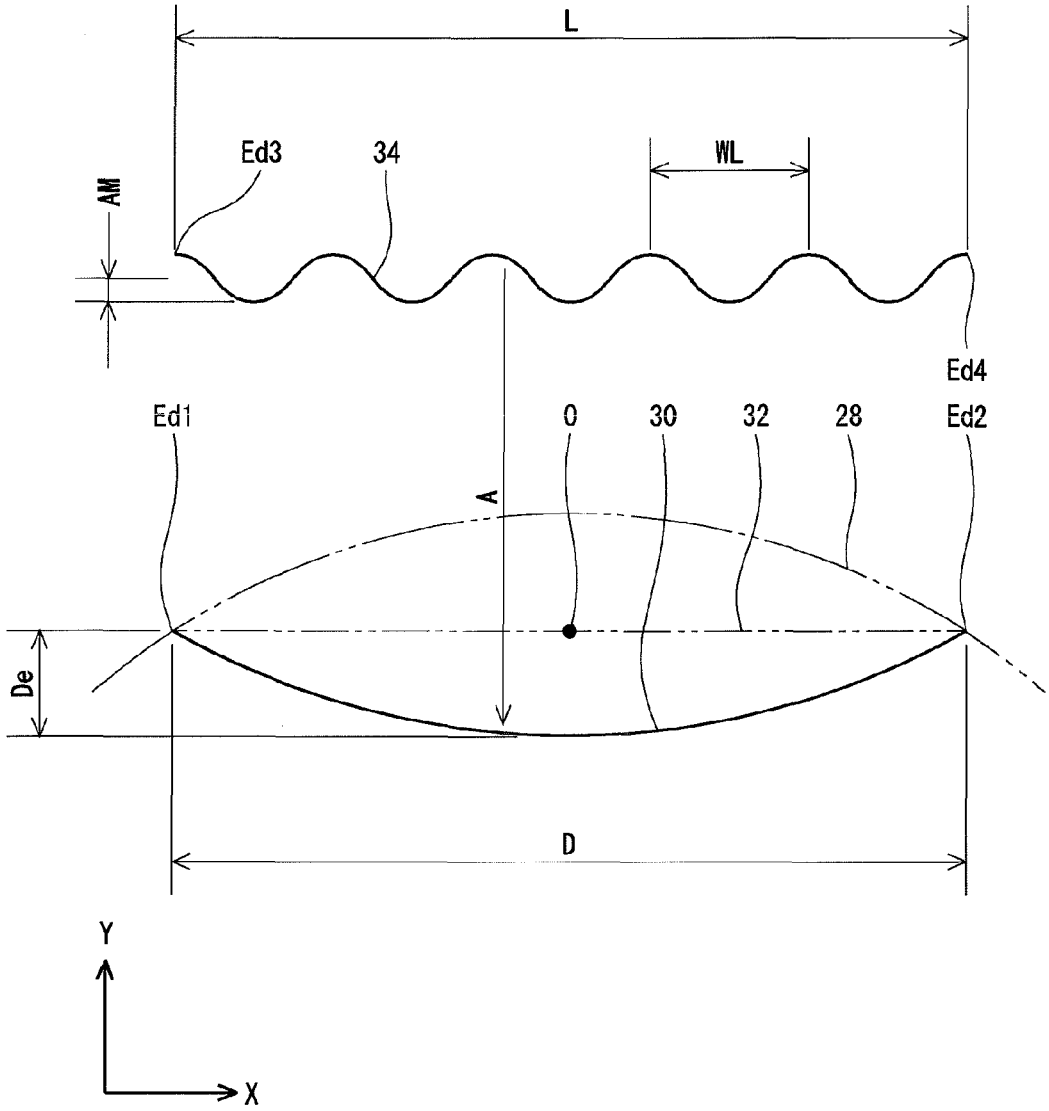
FIG. 5 is a view for illustrating a method for designing the dimple in FIG. 4.

In a method for designing the dimple 8, a circle 28 is assumed on an X-Y plane indicated in FIG. 5. The radius of the circle 28 is the same as the radius of the phantom sphere 12 (see FIG. 4) of the golf ball 2. Further, on the X-Y plane, a circular arc 30 is assumed. The circular arc 30 has one end Ed1 and another end Ed2 which are present on the circle 28. The circular arc 30 is downwardly convex. In FIG. 5, what is indicated by an arrow D is the length of a chord 32 corresponding to the circular arc 30. The coordinate of an origin O of the X-Y plane is (0,0). The origin O is the midpoint of the chord 32. The y coordinate of a point on the circular arc 30 is represented by the following mathematical formula (1).

$$y=(R-d)-\sqrt{(R^2-x^2)} \quad (1)$$

In the mathematical formula (1), R denotes the curvature radius of the circular arc 30, and d denotes the depth of the circular arc 30.

As shown in FIG. 5, a cosine curve 34 is assumed on the X-Y plane. The cosine curve 34 is bilaterally symmetrical. The cosine curve 34 has one end Ed3 and another end Ed4. In FIG. 5, what is indicated by an arrow L is the length of the cosine curve 34; what is indicated by an arrow WL is the wavelength of the cosine curve 34; and what is indicated by an arrow AM is the amplitude of the cosine curve 34. The length L of the cosine curve 34 is the same as the length D of the chord 32. The frequency of the cosine curve 34 is 5.0. The cosine curve 34 is moved in the direction indicated by an arrow A. As a result of the movement, the end Ed3 of the cosine curve 34 agrees with the end Ed1 of the circular arc 30, and the other end Ed4 of the cosine curve 34 agrees with the other end Ed2 of the circular arc 30.

Figure 6:
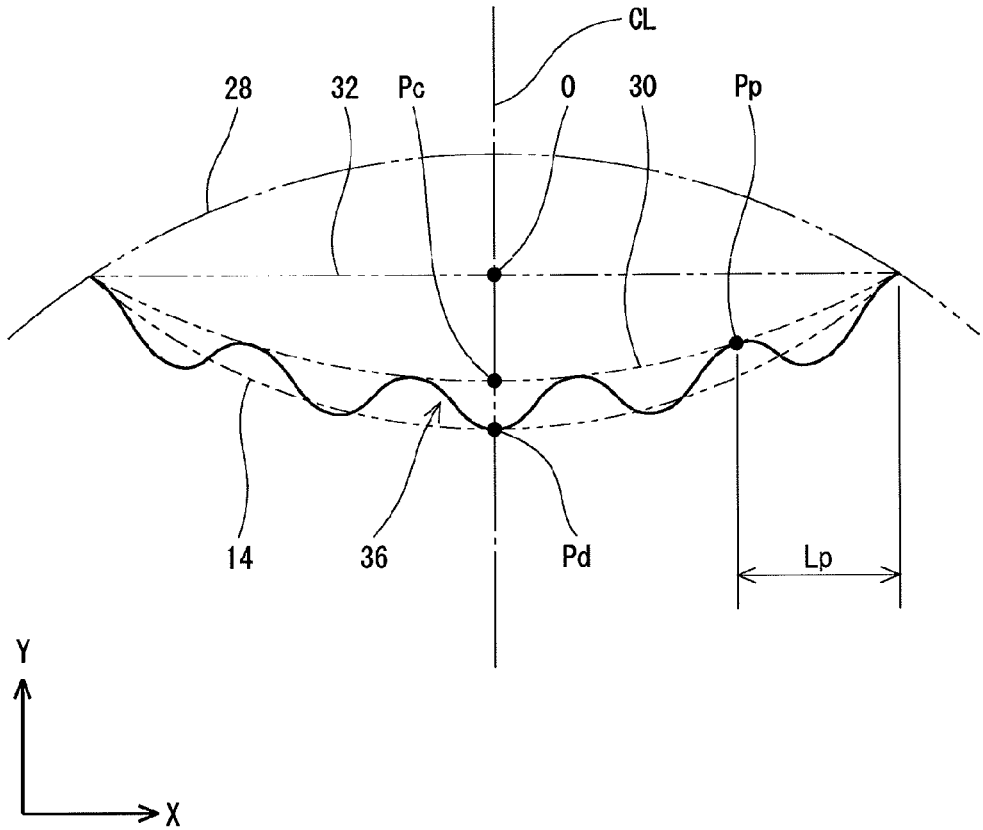
FIG. 6 is a view for illustrating the method for designing the dimple in FIG. 4.

The circular arc 30 and the cosine curve 34 are combined with each other. As a result of the combination, a wave-like curve 36 is obtained. The wave-like curve 36 is shown in FIG. 6. The y coordinate of the wave-like curve 36 is represented by the following mathematical formula (2).

$$y=(R-d)-\sqrt{(R^2-x^2)}+d\times Q\times\cos\left\{\left[\frac{\sin^{-1}\left(\frac{D}{2R}\right)+\sin^{-1}\left(\frac{x}{R}\right)}{\sin^{-1}\left(\frac{D}{2R}\right)}\right]\times\frac{S\times\pi}{180}\right\} \quad (2)$$

In the mathematical formula (2), Q denotes an amplitude adjustment coefficient, and S denotes an adjustment coefficient of a number of cycles. The coefficient Q is set as appropriate by taking into consideration a balance of the amplitude AM of the cosine curve 34 relative to the depth d of the circular arc 30. The coefficient S is set such that a desired number of cycles of the cosine curve 34 is achieved. In the cosine curve 34 shown in FIG. 5, S is 900. Thus, the number of cycles of the cosine curve 34 is 5.0.

In FIG. 6, what is indicated by a reference sign CL is a straight line passing through the central point Pc of the circular arc 30 and the origin O. The wave-like curve 36 is rotated 180 degrees about the straight line CL. On the basis of a trajectory through which the wave-like curve 36 passes by the rotation, a three-dimensional shape is obtained. The dimple 8 shown in FIG. 4 has this three-dimensional shape. The diameter Di of the dimple 8 is the same as the length D of the chord 32.

According to the finding by the inventor of the present invention, the dimple 8 having the projections and the recesses reduces drag when the golf ball 2 flies at a high speed. The drag is small at the initial stage of a trajectory of the golf ball 2. The dimple 8 having the projections and the recesses enhances a lift force when the golf ball 2 flies at a low speed. The lift force is great at the latter stage of the trajectory of the golf ball 2. By the golf ball 2, a long flight distance can be obtained.

In FIG. 4, what is indicated by a reference sign Pp is the peak of the projection closest to the edge Ed (namely, the first projection 16). The peak Pp is a point, on the surface of the first projection 16, which is located at the largest distance from the circular arc 14. This distance is measured in the depth direction of the dimple 8 (in the top-to-bottom direction in FIG. 4).

In FIG. 4, what is indicated by an arrow Lp is the distance from the edge Ed to the peak Pp. The ratio of the distance Lp to the radius (Di/2) of the dimple 8 is preferably equal to or greater than 20% but equal to or less than 70%. In a golf ball 2 having dimples 8 in each of which the ratio is equal to or greater than 20%, the drag is small at the initial stage of the trajectory. In this respect, the ratio is more preferably equal to or greater than 29% and particularly preferably equal to or greater than 40%. In a golf ball 2 having dimples 8 in each of which the ratio is equal to or less than 70%, the lift force is great at the latter stage of the trajectory. In this respect, the ratio is more preferably equal to or less than 60% and particularly preferably equal to or less than 49%.

In the dimple 8, one recess (namely, the first recess 20) is present between the projection closest to the edge Ed (namely, the first projection 16) and the edge Ed. This first recess 20 contributes to a reduction of the drag at the initial stage of the trajectory.

The number of cycles of the wave-like curve 36 obtained by combining the circular arc 30 and the cosine curve 34 is the same as the frequency of the cosine curve 34. As described above, the number of cycles of the cosine curve 34 shown in FIG. 5 is 5.0. Thus, the number of cycles of the wave-like curve 36 shown in FIG. 6 is 5.0. In light of flight performance, the number of cycles of the wave-like curve 36 is preferably equal to or greater than 2.5 but equal to or less than 7.0. In light of flight performance, the number of the projections in the wave-like curve 36 is preferably equal to or greater than 3 but equal to or less than 7.

By the wave-like curve 36 symmetrical about the straight line CL being rotated, the dimple 8 can be formed so as not to have directional properties. The dimple 8 which does not have directional properties has excellent aerodynamic symmetry.

In light of flight performance, the ratio of the amplitude AM of the cosine curve 34 to the depth De of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly preferably equal to or less than 20%.

In light of flight performance, the ratio (WL/D) of the wavelength WL of the cosine curve 34 to the length D of the chord 32 is preferably equal to or greater than (1/7) but equal to or less than (1/2.5). The ratio (WL/D) is more preferably equal to or greater than (1/6). The ratio (WL/D) is more preferably equal to or less than (1/4).

The golf ball 2 may have: dimples 8 each having a curved surface whose cross-sectional shape is the wave-like curve 36; and other dimples 8. The ratio (N1/N) of the number N1 of the dimples 8 each having a curved surface whose cross-sectional shape is the wave-like curve 36, to the total number N of the dimples 8, is preferably equal to or greater than 0.3, more preferably equal to or greater than 0.5, and particularly preferably equal to or greater than 0.7. Ideally, the ratio (N1/N) is 1.0.

In light of suppression of rising of the golf ball 2 during flight, the depth De of the circular arc 30 is preferably equal to or greater than 0.05 mm, more preferably equal to or greater than 0.08 mm, and particularly preferably equal to or greater than 0.10 mm. In light of suppression of dropping of the golf ball 2 during flight, the depth De is preferably equal to or less than 0.60 mm, more preferably equal to or less than 0.45 mm, and particularly preferably equal to or less than 0.40 mm.

The area s of the dimple 8 is the area of a region surrounded by the contour line when the center of the golf ball 2 is viewed at infinity. In the case of a circular dimple 8, the area s is calculated by the following mathematical formula.

$$s=(Di/2)^2*\Pi$$

In the golf ball 2 shown in FIGS. 1 to 6, the area of the dimple A is 15.62 $mm^2$; the area of the dimple B is 14.93 $mm^2$; and the area of the dimple C is 11.95 $mm^2$.

In the present invention, the ratio of the sum of the areas s of all the dimples 8 to the surface area of the phantom sphere 12 is referred to as an occupation ratio. From the standpoint that a sufficient dimple effect is achieved, the occupation ratio is preferably equal to or greater than 70%, more preferably equal to or greater than 78%, and particularly preferably equal to or greater than 80%. The occupation ratio is preferably equal to or less than 90%. In the golf ball 2 shown in FIGS. 1 to 6, the total area of all the dimples 8 is 4676.4 $mm^2$. The surface area of the phantom sphere 12 of the golf ball 2 is 4629 $mm^2$, and thus the occupation ratio is 81.6%.

In the present invention, the term "dimple volume" means the volume of a part surrounded by the surface of the dimple 8 and a plane which includes the contour of the dimple 8. In light of suppression of rising of the golf ball 2 during flight, the total volume of all the dimples 8 is preferably equal to or greater than 250 $mm^3$, more preferably equal to or greater than 260 $mm^3$, and particularly preferably equal to or greater than 270 $mm^3$. In light of suppression of dropping of the golf ball 2 during flight, the total volume is preferably equal to or less than 400 $mm^3$, more preferably equal to or less than 390 $mm^3$, and particularly preferably equal to or less than 380 $mm^3$.

Instead of the cosine curve 34, a sine curve may be combined with the circular arc 30, to obtain a wave-like curve. In the case of using a sine curve, the circular arc 30 and the sine curve are assumed between the straight line CL (see FIG. 6) and one edge Ed. The sine curve and the circular arc 30 are combined with each other, to obtain a half-wave-like curve. The half-wave-like curve is inverted about the straight line CL, to obtain another half-wave-like curve. These two half-wave-like curves are combined with each other, to obtain a wave-like curve. The wave-like curve is rotated 180 degrees about the straight line CL. As a result of the rotation, a dimple having projections and recesses is obtained. The dimple reduces drag when a golf ball flies at a high speed. The drag is small at the initial stage of a trajectory of the golf ball. The dimple having the projections and the recesses enhances a lift force when the golf ball flies at a low speed. The lift force is great at the latter stage of the trajectory of the golf ball. By the golf ball, a long flight distance can be obtained.

In the dimple obtained by using the sine curve as well, the ratio of the distance Lp between the peak of the projection closest to the edge Ed and the edge Ed, to the radius (Di/2) of the dimple, is preferably equal to or greater than 20% but equal to or less than 70%. In a golf ball having dimples in each of which the ratio is equal to or greater than 20%, the drag is small at the initial stage of a trajectory. In this respect, the ratio is more preferably equal to or greater than 29% and particularly preferably equal to or greater than 40%. In a golf ball having dimples in each of which the ratio is equal to or less than 70%, the lift force is great at the latter stage of a trajectory. In this respect, the ratio is more preferably equal to or less than 60% and particularly preferably equal to or less than 49%.

In light of flight performance, the number of cycles of the wave-like curve is preferably equal to or greater than 2.0 but equal to or less than 6.0. In light of flight performance, the number of the projections in the wave-like curve is preferably equal to or greater than 3 but equal to or less than 7.

In the dimple obtained by using the sine curve as well, one recess is preferably present between the projection closest to the edge Ed and the edge Ed. In the dimple as well, the ratio of the amplitude AM of the sine curve to the depth De of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly equal to or less than 20%. In light of flight performance, the ratio (WL/D) of the wavelength WL of the sine curve to the length D of the chord 32 is preferably equal to or greater than (1/6) but equal to or less than (1/2). The ratio (WL/D) is more preferably equal to or greater than (1/5). The ratio (WL/D) is more preferably equal to or less than (1/4).

In the dimple obtained by using the sine curve as well, the depth De of the circular arc 30 is preferably equal to or greater than 0.05 mm, more preferably equal to or greater than 0.08 mm, and particularly preferably equal to or greater than 0.10 mm. The depth De is preferably equal to or less than 0.60 mm, more preferably equal to or less than 0.45 mm, and particularly preferably equal to or less than 0.40 mm.

In a golf ball having the dimples obtained by using the sine curve as well, the occupation ratio is preferably equal to or greater than 70%, more preferably equal to or greater than 78%, and particularly preferably equal to or greater than 80%. The occupation ratio is preferably equal to or less than 90%. The total volume of the dimples is preferably equal to or greater than 250 $mm^3$, more preferably equal to or greater than 260 $mm^3$, and particularly preferably equal to or greater than 270 $mm^3$. The total volume is preferably equal to or less than 400 $mm^3$, more preferably equal to or less than 390 $mm^3$, and particularly preferably equal to or less than 380 $mm^3$.

EXAMPLES

Example 1

A rubber composition was obtained by kneading 100 parts by weight of a polybutadiene (trade name "BR-730", manufactured by JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold including upper and lower mold halves each having a hemispherical cavity, and heated at 170° C. for 18 minutes to obtain a core with a diameter of 39.7 mm. Meanwhile, a resin composition was obtained by kneading 50 parts by weight of an ionomer resin (trade name "Himilan 1605", manufactured by Du Pont-MITSUI POLYCHEMICALS Co., LTD.), 50 parts by weight of another ionomer resin (trade name "Himilan 1706", manufactured by Du Pont-MITSUI POLYCHEMICALS Co., LTD.), and 3 parts by weight of titanium dioxide. The above core was placed into a final mold having numerous pimples on its inside face, followed by injection of the above resin composition around the core by injection molding, to form a cover with a thickness of 1.5 mm. Numerous dimples having a shape which was the inverted shape of the pimples were formed on the cover. A clear paint including a two-component curing type polyurethane as a base material was applied to this cover to obtain a golf ball of Example 1 with a diameter of 42.7 mm and a weight of about 45.4 g. The golf ball has a PGA compression of about 85. The total volume of the dimples of the golf ball is 320 $mm^3$. The golf ball has a dimple pattern shown in FIGS. 2 and 3. The golf ball has dimples A, B, and C. Each of the dimples A, B, and C has the cross-sectional shape shown in FIG. 4.

Examples 2 to 4 and Comparative Examples 1 to 3

Golf balls of Examples 2 to 4 and Comparative Examples 1 to 3 were obtained in the same manner as Example 1, except the final mold was changed. The details of a cross-sectional shape of each dimple are as follows.

Example 2

(FIG. 7):Combination of a circular arc and a cosine curve.

Example 3

(FIG. 8):Combination of a circular arc and a sine curve.

Example 4

(FIG. 9):Combination of a circular arc and a cosine curve.

Comparative Example 1

(FIG. 10):Combination of a circular arc and a cosine curve.

Comparative Example 2

(FIG. 11):Combination of a circular arc and a sine curve.

Comparative Example 3

(FIG. 12):a circular arc (single radius).

Examples 5 and 6

Golf balls of Examples 5 and 6 were obtained in the same manner as Example 1, except the final mold was changed. In the golf ball of Example 5, a cross-sectional shape of each of dimples A and B is a wave-like shape, and a cross-sectional shape of each dimple C is a circular arc. In the golf ball of Example 6, a cross-sectional shape of each dimple A is a wave-like shape, and a cross-sectional shape of each of dimples B and C is a circular arc.

[Flight Distance Test]

A driver with a titanium head (trade name "XXIO", manufactured by SRI Sports Limited, shaft hardness: R, loft angle: 10.5°) was attached to a swing machine manufactured by Golf Laboratories, Inc. A golf ball was hit under the condition of a head speed of 40 m/sec, and the distance from the launch point to the stop point was measured. At the test, the weather was almost windless. The average values of data obtained by 12 measurements are shown in the following Tables 1 and 2.

TABLE 1

Results of Evaluation

Figure 7:
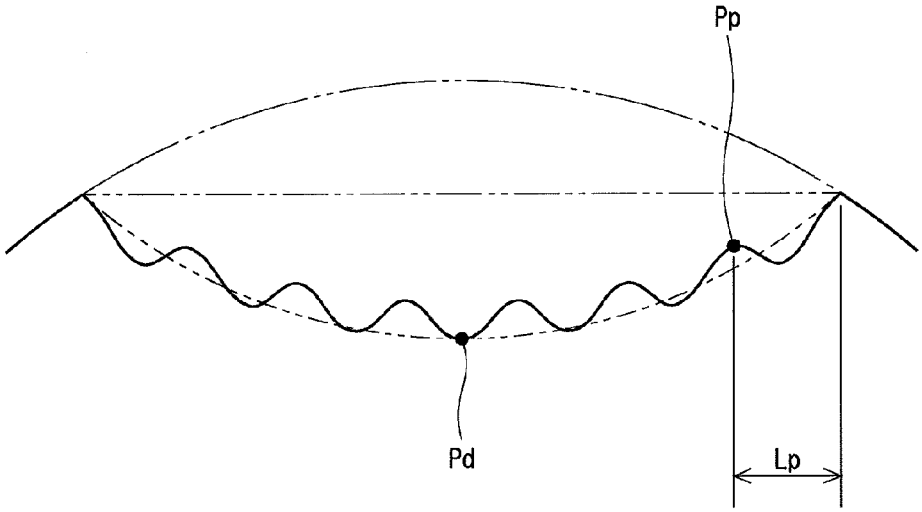
FIG. 7 is a cross-sectional view of a dimple of a golf ball according to Example 2 of the present invention.
Figure 8:
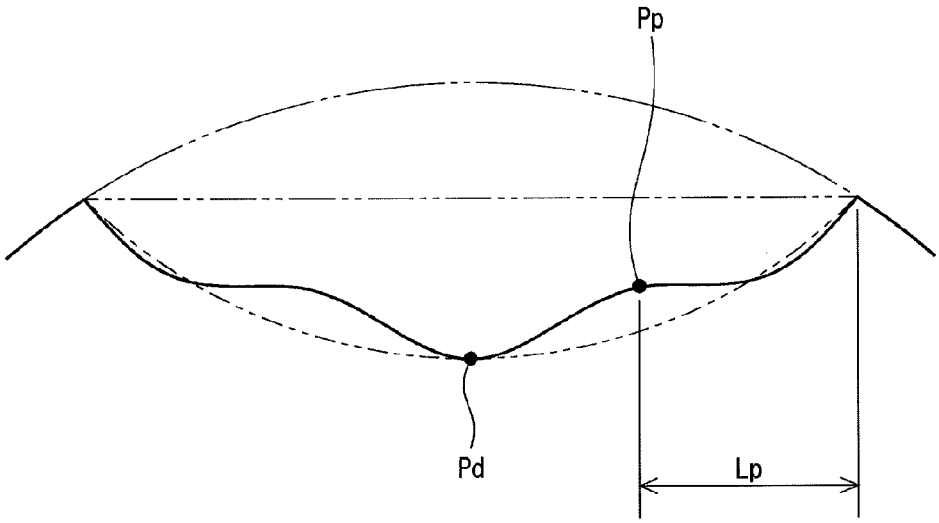
FIG. 8 is a cross-sectional view of a dimple of a golf ball according to Example 3 of the present invention.
Figure 9:
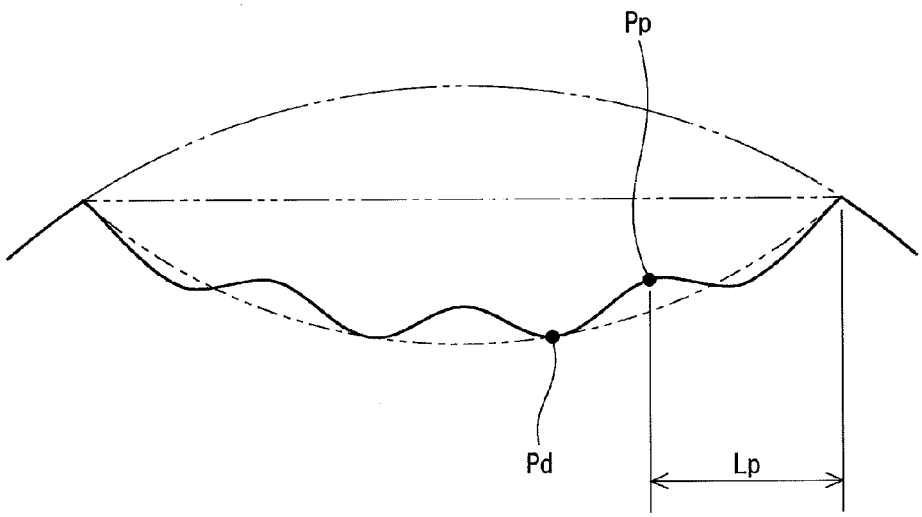
FIG. 9 is a cross-sectional view of a dimple of a golf ball according to Example 4 of the present invention.

| | | Example 2 | Example 1 | Example 3 | Example 4 |
|---|---|---|---|---|---|
| Dimple A | Diameter (mm) | 4.46 | 4.46 | 4.46 | 4.46 |
| | Total Number | 112 | 112 | 112 | 112 |
| | Shape | W.L. FIG. 7 | W.L. FIG. 4 | W.L. FIG. 8 | W.L. FIG. 9 |
| | Cycles | 7 | 5 | 2.5 | 4 |
| | Lp/(Di/2) (%) | 29 | 40 | 60 | 49 |
| | Projections | 6 | 4 | 2 | 3 |
| | Recesses | 6 | 4 | 2 | 2 |
| Dimple B | Diameter (mm) | 4.36 | 4.36 | 4.36 | 4.36 |
| | Total Number | 100 | 100 | 100 | 100 |
| | Shape | W.L. FIG. 7 | W.L. FIG. 4 | W.L. FIG. 8 | W.L. FIG. 9 |
| | Cycles | 7 | 5 | 2.5 | 4 |
| | Lp/(Di/2) (%) | 29 | 40 | 60 | 49 |
| | Projections | 6 | 4 | 2 | 3 |
| | Recesses | 6 | 4 | 2 | 2 |
| Dimple C | Diameter (mm) | 3.90 | 3.90 | 3.90 | 3.90 |
| | Total Number | 120 | 120 | 120 | 120 |
| | Shape | W.L. FIG. 7 | W.L. FIG. 4 | W.L. FIG. 8 | W.L. FIG. 9 |
| | Cycles | 7 | 5 | 2.5 | 4 |
| | Lp/(Di/2) (%) | 29 | 40 | 60 | 49 |
| | Projections | 6 | 4 | 2 | 3 |
| | Recesses | 6 | 4 | 2 | 2 |
| Flight distance (m) | | 206.0 | 206.5 | 205.5 | 206.5 |

W.L.: Wave-like

TABLE 2

Results of Evaluation

Figure 10:
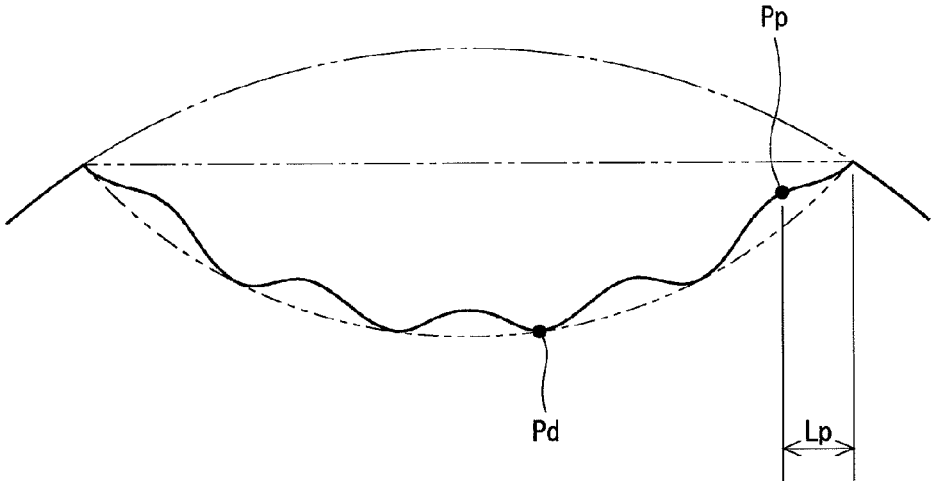
FIG. 10 is a cross-sectional view of a dimple of a golf ball according to Comparative Example 1.
Figure 11:
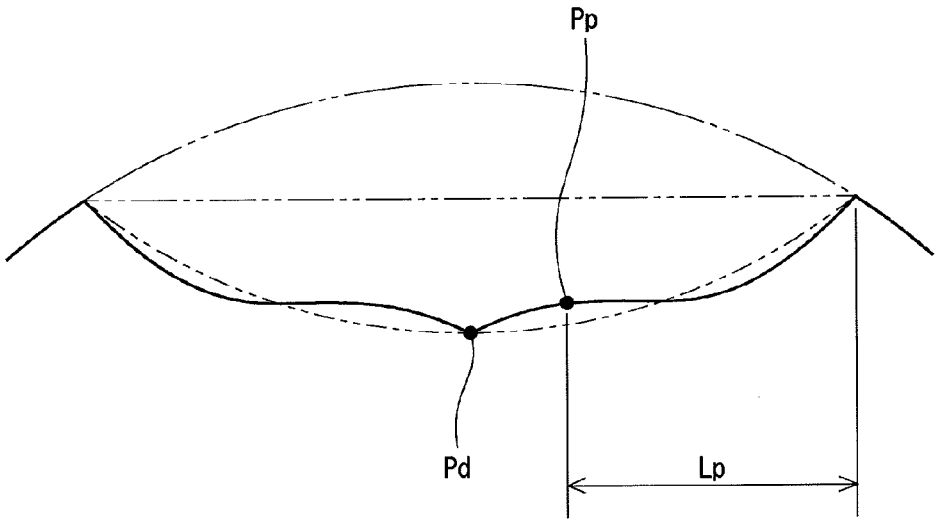
FIG. 11 is a cross-sectional view of a dimple of a golf ball according to Comparative Example 2.
Figure 12:
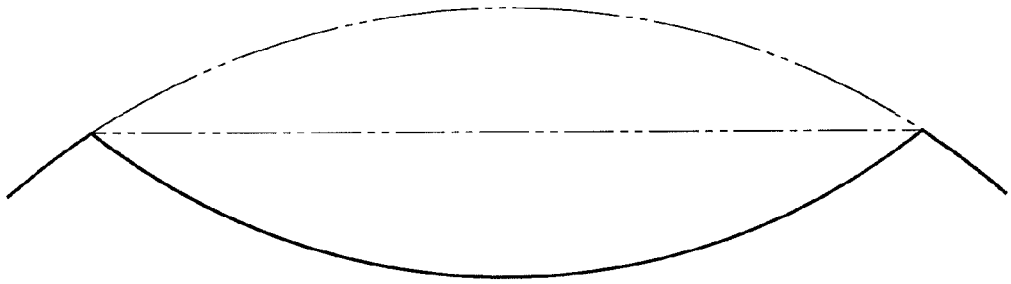
FIG. 12 is a cross-sectional view of a dimple of a golf ball according to Comparative Example.

| | | Example 5 | Example 6 | Compa. Example 1 | Compa. Example 2 | Compa. Example 3 |
|---|---|---|---|---|---|---|
| Dimple A | Diameter (mm) | 4.46 | 4.46 | 4.46 | 4.46 | 4.46 |
| | Total Number | 112 | 112 | 112 | 112 | 112 |
| | Shape | W.L. FIG. 4 | W.L. FIG. 4 | W.L. FIG. 10 | W.L. FIG. 11 | C.A. FIG. 12 |
| | Cycles | 5 | 5 | 5 | 2 | — |
| | Lp/(Di/2) (%) | 40 | 40 | 18 | 76 | — |
| | Projections | 4 | 4 | 5 | 2 | 0 |
| | Recesses | 4 | 4 | 0 | 2 | 0 |
| Dimple B | Diameter (mm) | 4.36 | 4.36 | 4.36 | 4.36 | 4.36 |
| | Total Number | 100 | 100 | 100 | 100 | 100 |
| | Shape | W.L. FIG. 4 | C.A. FIG. 12 | W.L. FIG. 10 | W.L. FIG. 11 | C.A. FIG. 12 |
| | Cycles | 5 | — | 5 | 2 | — |
| | Lp/(Di/2) (%) | 40 | — | 18 | 76 | — |
| | Projections | 4 | 0 | 5 | 2 | 0 |
| | Recesses | 4 | 0 | 0 | 2 | 0 |

TABLE 2-continued

| Results of Evaluation | | | | | | |
|---|---|---|---|---|---|---|
| | | Example 5 | Example 6 | Compa. Example 1 | Compa. Example 2 | Compa. Example 3 |
| Dimple C | Diameter (mm) | 3.90 | 3.90 | 3.90 | 3.90 | 3.90 |
| | Total Number | 120 | 120 | 120 | 120 | 120 |
| | Shape | C.A. FIG. 12 | C.A. FIG. 12 | W.L. FIG. 10 | W.L. FIG. 11 | C.A. FIG. 12 |
| | Cycles | — | — | 5 | 2 | — |
| | Lp/(Di/2) (%) | — | — | 18 | 76 | — |
| | Number of projections | 0 | 0 | 5 | 2 | 0 |
| | Recesses | 0 | 0 | 0 | 2 | 0 |
| Flight distance (m) | | 206.0 | 205.0 | 204.5 | 204.0 | 204.0 |

W.L.: Wave-like
C.A.: Circular arc

As shown in Tables 1 and 2, the golf balls of Examples have excellent flight performance. From the results of evaluation, advantages of the present invention are clear.

The above dimples are applicable to a one-piece golf ball, a multi-piece golf ball, and a thread-wound golf ball, in addition to a two-piece golf ball. The above description is merely for illustrative examples, and various modifications can be made without departing from the principles of the present invention.

What is claimed is:

1. A golf ball having a large number of dimples on a surface thereof, wherein at least some dimples have a curved surface, the cross-sectional shape of the curved surface is a wave-like curve having:

(1) one or more projections located above a circular arc which passes through one dimple edge, a deepest point of the dimple, and another dimple edge; and (2) one or more recesses located below the circular arc, and the ratio of a distance between a peak of a projection closest to a dimple edge and the dimple edge, to the radius of the dimple, is equal to or greater than 20% but equal to or less than 70%.

2. The golf ball according to claim 1, wherein one recess is present between the projection closest to the dimple edge and the dimple edge.

3. The golf ball according to claim 1, wherein the wave-like curve is obtained by combining a sine curve and a circular arc.

4. The golf ball according to claim 3, wherein the wave-like curve includes cycles with wave amplitudes, each complete cycle corresponds to a segment of the wave-like curve having two consecutive endpoints located at the same amplitude, and the number of cycles of the wave-like curve is equal to or greater than 2.0 but equal to or less than 6.0.

5. The golf ball according to claim 3, wherein the ratio of an amplitude of the sine curve to a depth of the circular arc is equal to or greater than 5% but equal to or less than 50%.

6. The golf ball according to claim 3, wherein the ratio of a wavelength of the sine curve to the length of a chord of the circular arc is equal to or greater than 1/6 but equal to or less than 1/2.

7. The golf ball according to claim 3, wherein the depth of the circular arc is equal to or greater than 0.05 mm but equal to or less than 0.60 mm.

8. The golf ball according to claim 1, wherein the wave-like curve is obtained by combining a cosine curve and a circular arc.

9. The golf ball according to claim 8, wherein the wave-like curve includes cycles with wave amplitudes, each complete cycle corresponds to a segment of the wave-like curve having two consecutive endpoints located at the same amplitude, and the number of cycles of the wave-like curve is equal to or greater than 2.5 but equal to or less than 7.0.

10. The golf ball according to claim 8, wherein the ratio of the amplitude of the cosine curve to the depth of the circular arc is equal to or greater than 5% but equal to or less than 50%.

11. The golf ball according to claim 8, wherein the ratio of the wavelength of the cosine curve to the length of a chord of the circular arc is equal to or greater than 1/7 but equal to or less than 1/2.5.

12. The golf ball according to claim 8, wherein the depth of the circular arc is equal to or greater than 0.05 mm but equal to or less than 0.60 mm.

13. The golf ball according to claim 1, wherein the wave-like curve has 3 to 7 projections.

14. The golf ball according to claim 1, wherein the diameter of each dimple is equal to or greater than 2.0 mm but equal to or less than 6.0 mm.

15. The golf ball according to claim 1, wherein the ratio of the number of dimples having a curved surface with a cross-sectional shape that is a wave-like curve, to the total number of the dimples, is equal to or greater than 0.3 but equal to or less than 1.0.

16. The golf ball according to claim 1, wherein the ratio of the sum of areas of all the dimples to the surface area of a phantom sphere is equal to or greater than 70% but equal to or less than 90%.

17. The golf ball according to claim 1, wherein the total volume of the dimples is equal to or greater than 250 $mm^3$ but equal to or less than 400 $mm^3$.

* * * * *